US005133283A

United States Patent [19]

Masuda

[11] Patent Number: 5,133,283

[45] Date of Patent: Jul. 28, 1992

[54] DEVELOPER UNIT

[75] Inventor: Jitsuo Masuda, Yamatotakada, Japan

[73] Assignee: Sharp Kabushiki Kaisha, Osaka, Japan

[21] Appl. No.: 639,656

[22] Filed: Jan. 10, 1991

[30] Foreign Application Priority Data

Jan. 11, 1990 [JP] Japan ..... 2-5130

[51] Int. Cl.[5] ..... G03G 15/09

[52] U.S. Cl. ..... 118/657; 355/245; 355/251

[58] Field of Search ..... 355/251, 253, 245, 246; 118/653, 657

[56] References Cited

FOREIGN PATENT DOCUMENTS 59-75269 4/1984 Japan .

61-28982 2/1986 Japan .

63-85663 4/1988 Japan .

*Primary Examiner*—A. T. Grimley

*Assistant Examiner*—Shuk Y. Lee

*Attorney, Agent, or Firm*—David G. Conlin; Linda M. Buckley

[57] ABSTRACT

A developer unit which includes a developer tank housing a developing roller including a sleeve and a magnet member both rotatable, wherein the magnet member is rotated longer than the sleeve, and wherein the rotating direction of the magnet member is opposite to that occurring when the sleeve and the magnet member rotate simultaneously. This strengthens the stirring force for the developer, thereby enhancing the chargeability of the toner and maintaining a desired image density.

2 Claims, 5 Drawing Sheets

DEVELOPER UNIT

BACKGROUND OF THE INVENTION

1. Field of the Invention

The present invention relates to a developer unit for use in image forming apparatus such as an electrophotographic copying machine, printer, or the like.

2. Description of the Prior Art

Two types of developer are known and widely used for effecting magnetic brush development of electrostatic images, one being a two-component developer consisting of a mixture of magnetic toner and magnetic carrier and the other being a one-component developer consisting only of magnetic toner.

The two-component developer requires that the magnetic carrier and toner be rubbed each other to charge toner particles, and this is difficult to achieve a good quality image unless the mixing ratio of the magnetic carrier to the toner is maintained within a prescribed range. Another difficulty is that the toner or toner component adheres to and accumulates on the surface of the magnetic carrier over a long period of use (such toner being generally called "spent toner"), thereby making it difficult to charge the toner.

The one-component developer has the advantage that it can be used for development of images without the use of a magnetic carrier, but the disadvantage is that the bristling of the magnetic brush substantially varies with the environmental changes such as temperature and humidity, thereby making it difficult to maintain a constant amount of bristling.

To overcome the problems pointed out above, Japanese Laid-Open Patent Publication No. 59-75269 (Prior Art 1) discloses a 1.5-component which consists of a bristling accelerating component composed of magnetic particles and a magnetic toner component composed of particles of resin/magnetic powder dispersion.

Since it is composed of a single kind of magnetic substance such as ferrite, the bristling accelerating component has superior magnetic characteristics to that of the magnetic toner component composed of magnetic powder dispersed in resin powder, and therefore improves the bristling of the magnetic brush on the sleeve.

In addition, when the bristling accelerating component is used in combination with the magnetic toner, the bristling of the magnetic brush is always maintained in good condition regardless of changes in the environment of the developer, the concomitant advantage being such that the mixing and stirring effect is given to the developer while it is being carried on the sleeve, serving to maintain the developer component in the powder state with good flowability regardless of changes in the environment such as temperature or the humidity.

According to the technique disclosed in Japanese Laid-Open Patent Publication No. 63-85663 (Prior Art 2), a magnetic roll is rotated, while the rotation of the developing sleeve is stopped, during the time of operation other than recording, so that the developer bristles formed on the developer sleeve stand up high and a large amount of developer flows from the blade. This helps to reduce the pressure applied to the developer in the area surrounded by the developing sleeve, the blade, and the net-like member, and facilitates remixing with the developer which has been being mixed and stirred in that area, thereby assuring preparation of a uniform mixture.

In the developing method of Prior Art 1 using the 1.5-component developer, the toner is charged due to the movement of the developer on the sleeve. However, the flow of the developer is limited by the doctor, etc., and the amount of the developer carried on the sleeve decreases, with a resultant drop in the ability of the sleeve to stir the developer. The problem is that when this stirring ability drops, the toner shows a marked drop in its chargeability, with a resultant drop in the image density.

In Prior Art 2, when the pressure is reduced on the developer in the area surrounded by the developing sleeve, the blade, and the net-like member, a large amount of developer flows from the blade to reduce the pressure so that the toner density that has been decreased can be restored, but the charge amount cannot be restored.

Another problem with Prior Art 2 is that when the construction is such that the pressure increases on the developer on the upstream side of the blade, the toner density cannot be restored because the pressure is not reduced.

SUMMARY OF THE INVENTION

The developer unit of this invention, which overcomes the above-discussed and numerous other disadvantages and deficiencies of the prior art, comprises a developer tank housing a developing roller consisting of a sleeve and a magnet member disposed rotatably relative to each other; a toner supply tank for supplying magnetic toner to the developer tank; a doctor disposed in the developer tank for limiting the amount of developer carried on the sleeve; a stirring area for stirring the supplied magnetic toner into the developer, which is formed extending from a toner supply opening communicating between the toner supply tank and the developer tank to the doctor; and a control section for controlling so that the magnet member is rotated for a longer period of time than the sleeve in order to enhance the stirring capacity in the stirring area, the control section having a rotating direction switching means for reversing the rotating direction of the magnet member when the magnet member is rotated independently from when it is rotated simultaneously with the sleeve.

According to another aspect of the present invention, the control section further comprises a rotating speed switching means for reducing the rotating speed of the magnet member when the magnet member is rotated independently as compared with that when it is rotated simultaneously with the sleeve.

Thus, the invention described herein makes possible the objective of providing a developer unit capable of maintaining the toner charge amount by stirring the developer efficiently.

BRIEF DESCRIPTION OF THE DRAWINGS

This invention may be better understood and its numerous objects and advantages will become apparent to those skilled in the art by reference to the accompanying drawings as follows.

DESCRIPTION OF THE PREFERRED EMBODIMENTS

Example 1

Figure 1:
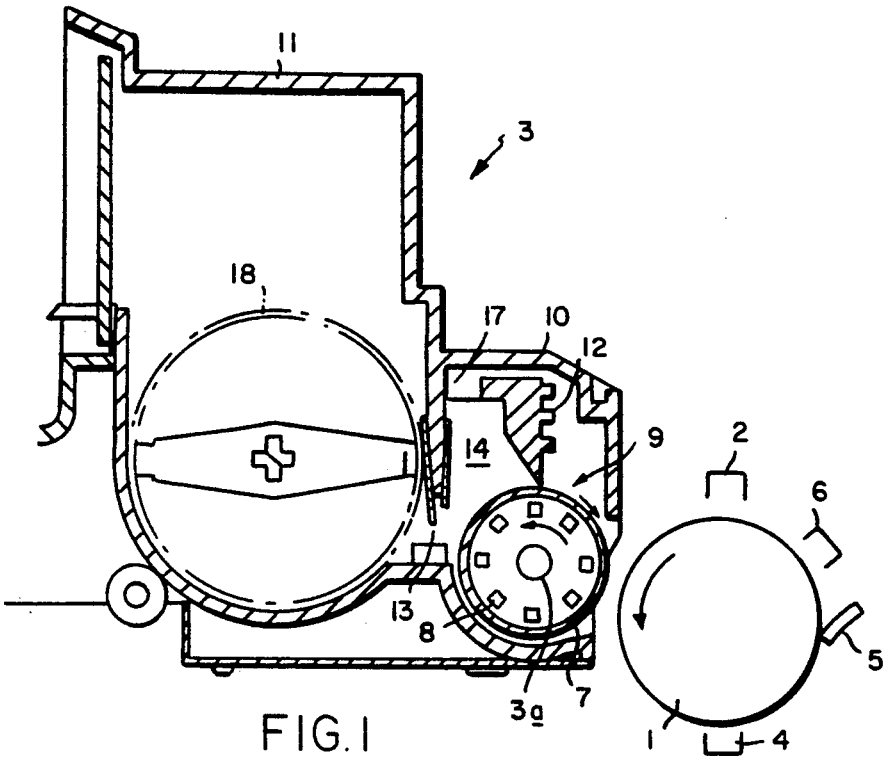
FIG. 1 is a cross sectional view of a developer unit in a first example of the present invention.

As shown in FIG. 1, an electrophotographic apparatus equipped with a developer unit according to the present invention comprises a charge unit 2 for charging a rotatable photoconductor 1; an exposure unit (not shown) for projecting light onto the photoconductor 1 to form an electrostatic latent image thereon; a developer unit 3 for developing the electrostatic latent image into a toner image; a transfer unit 4 for transferring the toner image on the photoconductor 1 onto copy paper; a cleaning unit 5 for removing untransferred toner remaining on the photoconductor 1; a discharge unit 6 for removing charge on the photoconductor 1; and a fixing unit (not shown) for fixing the toner image transferred by the transfer unit 4 to the copy paper.

The developer unit 3 of the present invention comprises: a developer tank 10 housing a developing roller 9 consisting of a sleeve 7 and a magnet member 8 disposed rotatably relative to each other; and a toner supply tank 11 for supplying magnetic toner to the developer tank 10; a doctor 12 disposed in the developer tank 10 for limiting the amount of developer carried on the sleeve 7; a stirring area 14 for mixing and stirring the supplied magnetic toner into the developer, which is formed extending from a toner supply opening 13 communicating between the toner supply tank 11 and the developer tank 10 to the doctor 12; and a control section 15 for controlling so that the magnet member 8 is rotated for a longer period of time than the sleeve 7 in order to enhance the stirring capacity in the stirring area 14, the control section 15 having a rotating direction switching means 16 for reversing the rotating direction of the magnet member 8 when the magnet member 8 is rotated independently from when it is rotated simultaneously with the sleeve 7.

The sleeve 7 is formed from a non-magnetic, conductive material of a cylindrical shape, and is supported rotatably inside the developer unit housing. Inside the sleeve 7, there are disposed magnet member 8 facing each other and alternately magnetized N and S poles, the magnet member 8 being fixed to a shaft 3*a* supported rotatably inside the developer unit housing. The sleeve 7 is rotated in the reverse direction to that of the rotation of the photoconductor 1, while the magnet member 8 is rotated in the reverse direction to that of the rotation of the sleeve 7.

The toner supply tank 11 is separated from the developer tank 10 by a partition plate 17, and the toner supply opening 13 is formed beneath the partition plate 17.

Inside the toner supply tank 11, a toner stirring roller 18 is disposed rotatably which stirs the magnetic toner and feeds it into the developer tank 10 through the toner supply opening 13.

The doctor 12 is disposed downstream of the toner supply opening 13 in the transporting direction of the developer, and is fixed to the developer unit housing in such a way as to face the surface of the sleeve 7 with a very small gap left therebetween.

The developer consists of a bristling accelerating component composed of magnetic particles and a magnetic toner component composed of resin/magnetic powder dispersion of 5 to 50 μm particle size. Magnetic materials such as ferrite and iron fillings can be used as the bristling accelerating component, and a mixing ratio over a broad range from 10:90 to 90:10 is allowed with respect to the magnetic toner.

The stirring area 14 is an area extending from the toner supply opening 13 to the doctor 12 and surrounded by the sleeve 7 and the partition plate 17. The developer which is carried on the sleeve 7 by the magnetic force of the magnet member 8 with the rotation of the sleeve 7 is limited and scraped off by the doctor 12. The scraped developer is caused to flow upwardly along the doctor 12 in the stirring area 14, causing a stream moving toward the toner supply opening 13 and stirring and rubbing the developer against each other under pressure.

Figure 2:
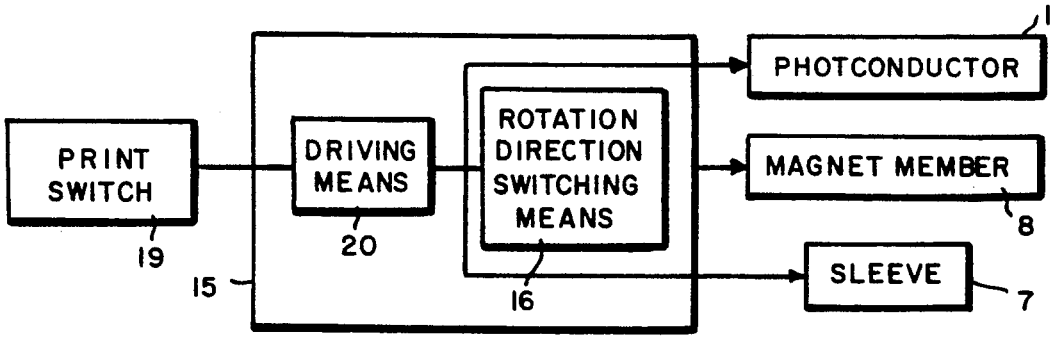
FIG. 2 is a control block diagram of the same.

As shown in FIG. 2, the control section 15 consists of a conventional single-chip microcomputer, which includes the previously mentioned rotating direction switching means 16, as well as a driving means 20 for controlling the rotational driving of the photoconductor 1, the magnet member 8 and the sleeve 7 in response to output signals from a print switch 19 used to start a print operation. When a print signal is input, the driving means 20 works to start the rotation of the photoconductor 1 and the magnet member 8 at the same time, and after a prescribed time, works to start the rotation of the sleeve 7 and stops all rotation upon termination of the print operation.

The rotating direction switching means 16 has the function to rotate the magnet member 8 in the opposite direction to that of the rotation of the photoconductor 1 in response to an output from the driving means 20, and after a prescribed time, to stop the rotation of the magnet member 8 temporarily and then rotate it in the same direction as that of the rotation of the photoconductor 1 synchronized with the rotation of the sleeve 7.

Figure 3:
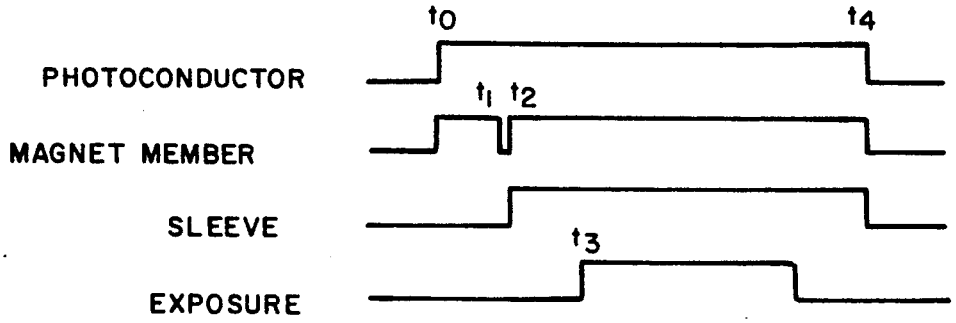
FIG. 3 is a timing chart of the same.

In the above construction, when the print switch 19 is turned on for a printing operation, a print signal is sent to the control section 15, and as shown in FIG. 3, at time $t_0$, the photoconductor 1 and the magnet member 8 rotate in opposite directions to each other by the driving means 20.

At this time, the developer is not transported by the sleeve 7, but remains filled under pressure in the stirring area 14 being limited by the doctor 12. In these circumstances, since the magnetic pole position changes at the stirring area 14 with the rotation of the magnet member 8, the rolling of the developer is facilitated, and the developer bristles formed on the sleeve 7 stand up high and stir the developer filled in the stirring area 14, causing the toner particles to rub against the magnetic particles to charge the toner.

Also, since the sleeve 7 is not rotating, there is no developer flowing through the gap under the doctor 12, and therefore, there is hardly any developer carried toward the photoconductor 1, which serves to prevent the surface of the photoconductor 1 from being worn by the magnetic brush formed on the sleeve 7.

At time $t_1$, the magnet member 8 stops temporarily, and immediately after that, at time $t_2$, the magnet member 8 is rotated with its rotating direction switched by the rotating direction switching means 16 to the same direction as that of the photoconductor 1. At the same time the rotation of the sleeve 7 is started. As a result, the developer is made to adhere to the sleeve 7 by magnetic force, and is carried onto the photoconductor 1 with the rotation of the sleeve 7 and the magnet member 8, the adhering amount being limited by the doctor 12.

Then, at time $t_3$, the exposure unit is activated to project light onto the photoconductor 1 to form an electrostatic latent image thereon. The magnetic brush of developer on the sleeve 7 brushes the electrostatic latent image, causing the magnetic toner to transfer to the photoconductor 1 to develop the image.

The developer used for development but not transferred to the photoconductor 1 remains on the sleeve 7 and continues to be carried thereon.

When the toner density in the developer is reduced in the stirring area 14, the magnetic toner fed through the toner supply opening 13 by means of the toner stirring roller 18 in the toner supply tank 11 is attracted by the magnetic force of the magnet member 8 and is stirred into the developer to uniformly mix so as to produce developer having a prescribed toner density.

The developer, being stirred sufficiently in the stirring area 14, is carried up to the doctor 12 by the rotation of the sleeve 7 and the magnet member 8. The adhering amount being limited by passing through the gap between the doctor 12 and the sleeve 7, part of the developer is carried onto the photoconductor 1. On the other hand, the developer limited and scraped off by the doctor 12 moves toward the upper part of the stirring area 14 and circulates with pressure to stir the developer being carried and charge the toner by friction with the developer.

Next, at time $t_4$ when the developing process is completed, the photoconductor 1, the magnet member 8, and the sleeve 7 stop all together.

Figure 4:
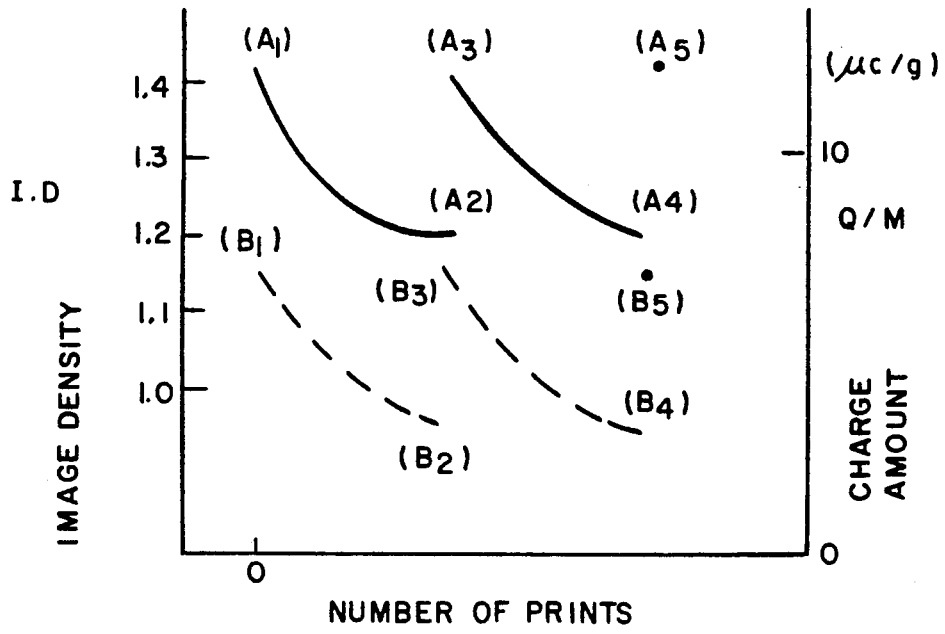
FIG. 4 is a chart illustrating how the toner charge amount and the image density change when a magnet member is rotated independently at a given time.

When continuous printing is performed with the sleeve 7 and the magnet member 8 being rotated together, as shown in FIG. 4, the image density indicated by the solid line and the toner charge amount indicated by the broken line decrease from A1 to A2 and from B1 to B2, respectively, as the number of prints made increases. At this point, when the magnet member 8 is rotated independently, as described in the present example, the image density and the charge amount increase to A3 and B3, respectively, both recovering to the initial levels.

Thereafter, when continuous printing is made again with the sleeve 7 and the magnet member 8 rotated together, the image density and the charge amount drops to A4 and B4, respectively. When the magnet member 8 is rotated independently again, it is noted that the image density and the charge amount recover up to A5 and B5, respectively.

Figure 5:
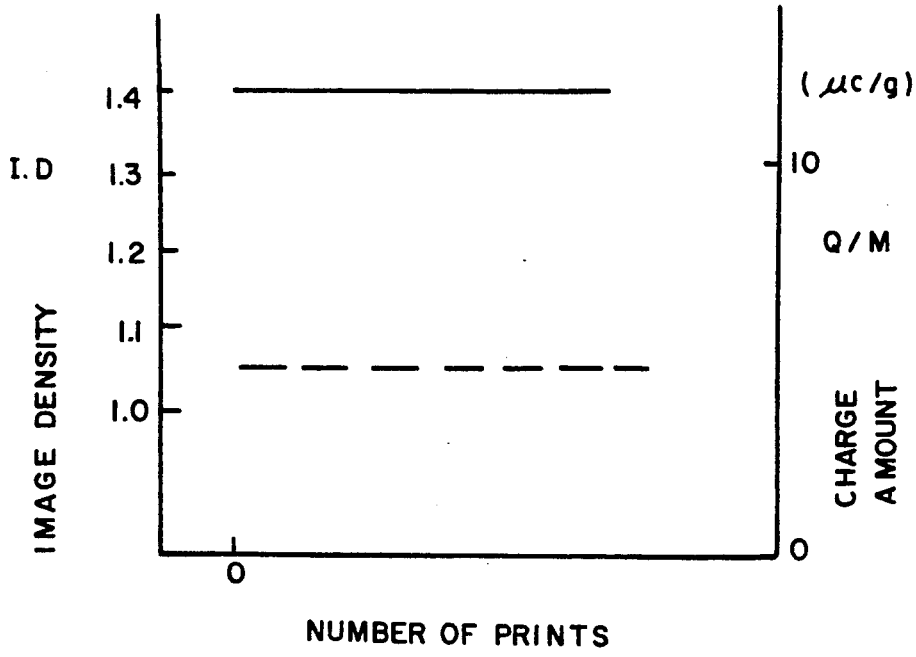
FIG. 5 is a chart illustrating how the toner charge amount and the image density change when the control subsumed under the first example is performed from the start of a copying operation.

On the other hand, when continuous printing is made by performing the control of this example from the beginning of the printing operation, it can be seen that the image density indicated by the solid line and the toner charge amount indicated by the broken line in FIG. 5 are maintained at the prescribed levels despite the increase in the number of prints made.

Thus, by rotating the magnet member 8 for a longer period of time than the sleeve 7 with the rotation of the magnet member 8 reversed when it is rotated independently from when it is rotated simultaneously with the sleeve 7, the stirrability of the developer is enhanced and frictional charging is facilitated, which serves to improve the chargeability of the toner and thereby to prevent the image density from dropping.

Example 2

Figure 6:
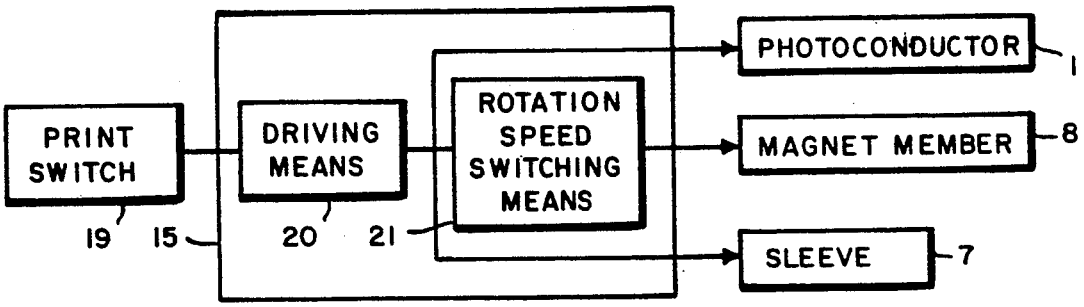
FIG. 6 is a control block diagram of a second example of the present invention.
Figure 7:
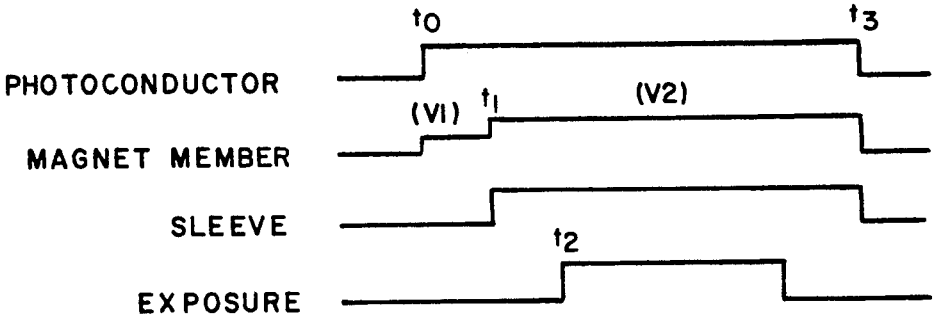
FIG. 7 is a timing chart of the same.

FIG. 6 is a control block diagram of a second example of the present invention, and FIG. 7 is a timing chart for the same.

As shown, the control section 15 in the developer unit of this example has a rotating speed switching means 21 for reducing the rotating speed V1 at which the magnet member 8 is rotated independently as compared to the rotating speed V2 at which the magnet member 8 is rotated simultaneously with the sleeve 7. Otherwise, the construction is the same as that of the first example.

The rotating speed switching means 21 works to start the rotation of the magnet member 8 at time $t_0$ at the rotating speed V1 in the same direction as that of the rotation of the photoconductor 1, and after a prescribed time, at time $t_1$, to rotate the magnet member 8 at the rotating speed V2 which is faster than the rotating speed V1.

With the above construction, the second example achieves the same effect as achieved in the first example. When the magnet member 8 is rotated independently at a high speed, the problem is that the developer leaks from the developer tank 10 because the developer is flowing slightly along the sleeve 7. However, in this example, since the rotation is reduced, the flowing of the developer is suppressed to prevent the developer from leaking from the developer tank 10.

Example 3

Figure 8:
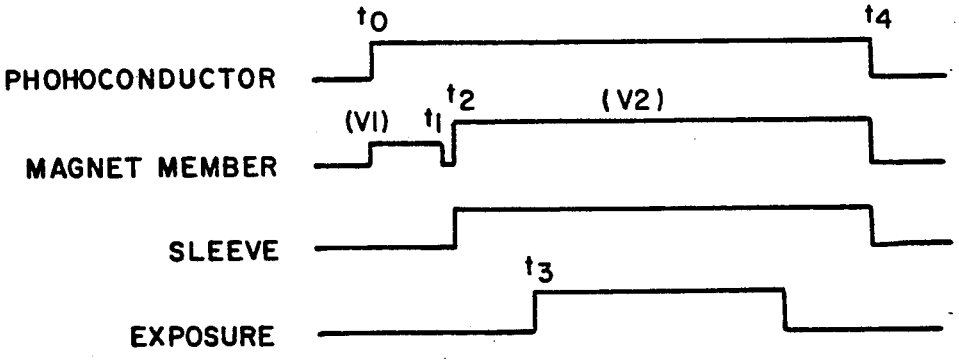
FIG. 8 is a timing chart illustrating the operation of a third example of the present invention.

FIG. 8 is a timing chart illustrating the operation of a third example of the present invention.

In this example, the rotating direction switching adopted in the first example is used in conjunction with the rotating speed switching adopted in the second example, to control the rotation of the magnet member 8.

As shown, at time $t_0$, the rotation of the photoconductor 1 is started, and at the same time, the magnet member 8 is started for rotation at the rotating speed V1 in the opposite direction to that of the rotation of the photoconductor 1. Then, at time $t_1$, the magnet member 8 is stopped temporarily, and immediately after that, at time $t_2$, the magnet member 8 is driven for rotation at the rotating speed V2 in the same direction as that of the rotation of the photoconductor 1. At the same time rotation of the sleeve 7 is started. Then, at time $t_4$, when the developing process is completed, the photoconductor 1, the magnet member 8, and the sleeve 7 are stopped all at the same time.

Therefore, in this example, the image density is prevented from dropping while preventing the developer leakage.

Figure 9:
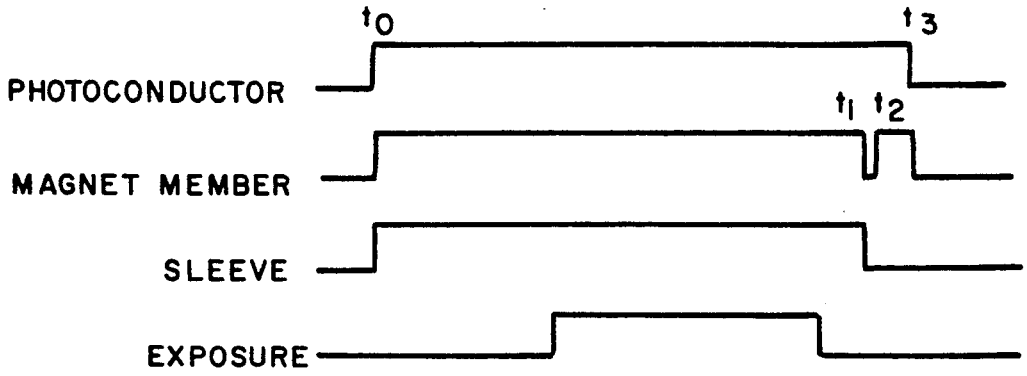
FIGS. 9 and 10 are timing charts illustrating examples of other applications relating to the first example.

In the first example, the magnet member 8 and the photoconductor 1 are started for rotation at the same time prior to the rotation of the sleeve 7, but alternatively, the control may be performed, as shown in FIG. 9, wherein: the photoconductor 1, the magnet member 8, and the sleeve 7 are all started at the same time, and then at time $t_1$, the sleeve 7 and the magnet member 8 are stopped, immediately followed by time $t_2$ at which the magnet member 8 is driven for rotation in the opposite direction as that of the rotation of the photoconductor 1, and then at time $t_3$, the photoconductor 1 and the magnet member 8 are stopped at the same time.

Figure 10:
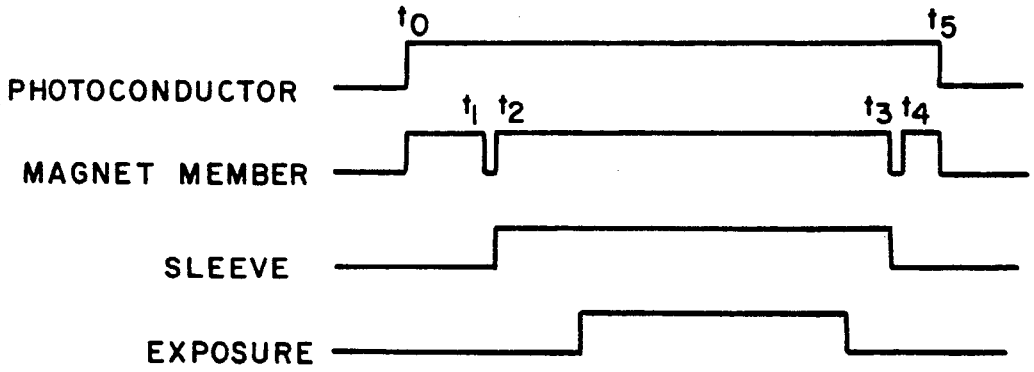

Also, as shown in FIG. 10, it may be so controlled that the rotating direction of the magnet member 8 are reversed before and after the rotation of the sleeve 7.

Figure 11:
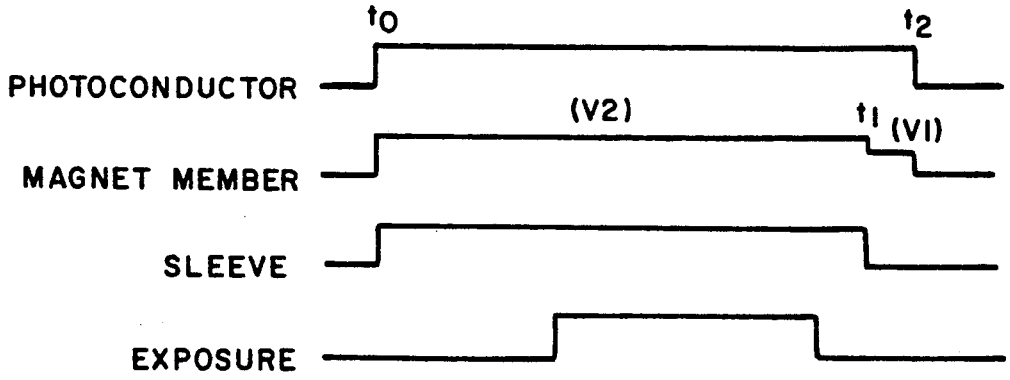
FIGS. 11 and 12 are timing charts illustrating examples of other applications relating to the second example.
Figure 12:
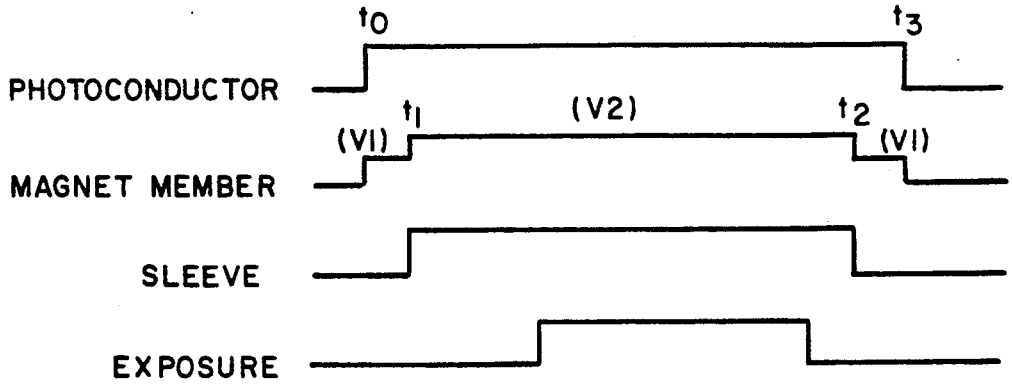
Figure 13:
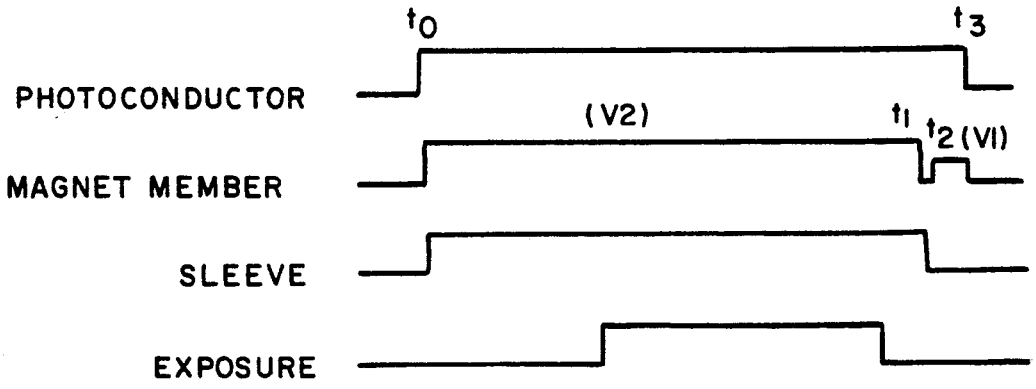
FIGS. 13 and 14 are timing charts illustrating examples of other applications relating to the third example.
Figure 14:
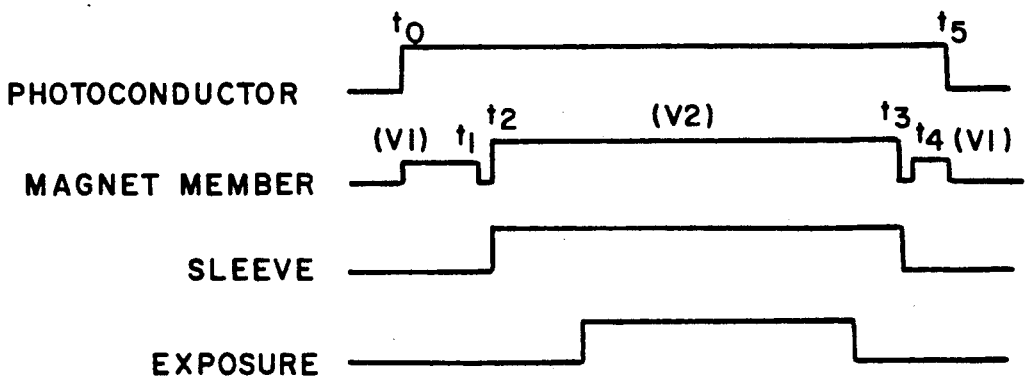

Furthermore, in the second example, the control may be performed, as shown in FIGS. 11 or 12, so that the magnet member 8 is rotated at a slower speed after stopping the rotation of the sleeve 7 or before and after the rotation of the sleeve 7. Also, in the third embodiment, the control may be preformed as shown in FIGS. 13 and 14.

It is understood that various other modifications will be apparent to and can be readily made by those skilled in the art without departing from the scope and spirit of this invention. Accordingly, it is not intended that the scope of the claims appended hereto be limited to the description as set forth herein, but rather that the claims be construed as encompassing all the features of patentable novelty that reside in the present invention, including all features that would be treated as equivalents thereof by those skilled in the art to which this invention pertains.

What is claimed is:

1. A developer unit comprising a developer tank housing a developing roller consisting of a sleeve and a magnet member disposed rotatably relative to each other, a toner supply tank for supplying magnetic toner to the developer tank, a doctor disposed in the developer tank for limiting an amount of developer carried on the sleeve, a stirring area for stirring the supplied magnetic toner into the developer, which is formed extending from a toner supply opening communicating between the toner supply tank and the developer tank to the doctor, and a control section for controlling so that the magnetic member and the sleeve are rotated in one direction during development and the magnetic member alone is rotated in the opposite direction during non-development in order to strengthen a stirring force in the stirring area.

2. A developer unit according to claim 1, wherein said control section rotates said magnet member alone in the opposite direction at a lower speed than that during development.

* * * * *